US007198155B2

(12) United States Patent
Otsuka et al.

(10) Patent No.: US 7,198,155 B2
(45) Date of Patent: Apr. 3, 2007

(54) PACKING CASE AND PACKING METHOD FOR PACKING IMAGE FORMING APPARATUS, AND IMAGE FORMING APPARATUS

(75) Inventors: Yoshinori Otsuka, Nara (JP); Yoshiaki Sanada, Ikoma (JP); Kouichi Mihara, Fujiidera (JP); Haruko Yoneda, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 190 days.

(21) Appl. No.: 10/430,441

(22) Filed: May 7, 2003

(65) Prior Publication Data

US 2003/0209464 A1 Nov. 13, 2003

(30) Foreign Application Priority Data

May 9, 2002 (JP) ..... 2002-134458

(51) Int. Cl.
*B65D 81/02* (2006.01)

(52) U.S. Cl. ..... 206/576; 206/320; 206/523; 206/586

(58) Field of Classification Search ..... 206/576, 206/320, 521, 523, 586, 591, 592, 594, 525, 206/485
See application file for complete search history.

(56) References Cited

U.S. PATENT DOCUMENTS 5,366,080 A * 11/1994 Carstersen et al. ..... 206/523
5,439,114 A * 8/1995 Lingle et al. ..... 206/586
5,833,057 A * 11/1998 Char et al. ..... 206/523
6,431,362 B1 * 8/2002 Araki et al. ..... 206/485
6,554,133 B1 * 4/2003 Kropf et al. ..... 206/320

FOREIGN PATENT DOCUMENTS

JP 5-90501 U 12/1993

* cited by examiner

*Primary Examiner*—Luan K. Bui
(74) *Attorney, Agent, or Firm*—Birch, Stewart, Kolasch & Birch, LLP

(57) ABSTRACT

A packing case for an image forming apparatus that includes: a first packing member 5 for packing an image forming apparatus main body 1 including a reading section 11 having a scanner unit, an image forming section 14 having an image forming unit 12, and a sheet feed unit 13 for feeding a sheet to the image forming unit 12, and a sheet storage space 16, formed to be open to outside between the reading section 11 and the image forming section 14, for storing a sheet transported from the image forming unit 12; and a second packing member 4 for packing a toner cartridge 2 capable of being inserted into and removed from the image forming apparatus main body 1, in which the second packing member 4 is inserted and fixed in the sheet storage space 16.

5 Claims, 13 Drawing Sheets

PACKING CASE AND PACKING METHOD FOR PACKING IMAGE FORMING APPARATUS, AND IMAGE FORMING APPARATUS

BACKGROUND OF THE INVENTION

1. Field of the Invention

The present invention relates to a packing case and a packing method, for packing an image forming apparatus which forms an image according to image data read by a reading section having a scanner unit, and to an image forming apparatus packed by such packing case.

2. Description of Related Art

As conventional image forming apparatuses, there are mainly two types of known image forming apparatuses. One type is a large image forming apparatus which is relatively high in height and installed mainly on a floor, and the other type is a small image forming apparatus which is relatively short in height and placed on a stand such as a cabinet.

FIG. 1 is a schematic view showing an example of the structure of a conventional large image forming apparatus. A main component of a conventional image forming apparatus of this type is an image forming apparatus main body 103 including a reading section 100 having a scanner portion for reading a document image; an image forming unit 101 for forming an image according to image data read by the reading section 100; and a sheet transport section 102 for transporting a sheet to the image forming unit 101 and also transporting the sheet from the image forming unit 101 to a sheet ejection unit. Moreover, this image forming apparatus main body 103 has a toner cartridge 104 (see FIG. 2) which contains toner to be supplied to the image forming unit 101 and can be inserted into and removed from the image forming apparatus main body 103.

A scanner portion 105 is composed of a document platen 106 made of a transparent glass, an automatic double-sided document feeder (ADF) 107 for automatically feeding and transporting a document onto the document platen 106, a document image reading section, namely, a scanner unit 108 for reading an image of a document placed on the document platen 106 by scanning.

The document image read by the scanner portion 105 is sent as image data to a later-described image data input unit, and then predetermined image processing is performed on the image data.

The automatic double-sided document feeder 107 is a device for automatically feeding a plurality of document sheets set on a document tray, not shown, one sheet at a time onto the document platen 106 of the scanner unit 108. Further, in order to allow the scanner unit 108 to read one side or both sides of a document, according to a selection made by an operator, this automatic double-sided document feeder 107 comprises a transport path for a single-sided document, a transport path for a double-sided document, transport path switching means, a sensor group for understanding and managing the state of documents passing the respective transport paths, and a control unit. For this automatic double-sided document feeder 107, since many applications were filed and developed into commercial products conventionally, no further explanation will be given here.

The scanner unit 108 constituting the scanner portion 105 for reading an image of a document on the document platen 106 comprises: a first scanning unit 111 including a lamp reflector assembly 109 for exposing a document surface and a first reflective mirror 110 for reflecting reflected light from the document so as to guide a reflected light image from the document to a photoelectric conversion device (CCD); a second scanning unit 114 including second and third reflective mirrors 112 and 113 for guiding the reflected light image from the first reflective mirror 110 to the photoelectric conversion device (CCD); an optical lens 115 for focusing the reflected light image from the document through the above-described reflective mirrors onto the device (CCD) for converting it into electrical image signals; and the photoelectric conversion device 116 for converting the reflected light image from the document into electrical image signals.

The scanner portion 105 is designed to read a document image by moving the scanner unit 108 along the lower face of the document platen 106 while sequentially placing a document to be read on the document platen 106 by the related operations of the automatic double-sided document feeder 107 and scanner unit 108.

The first scanning unit 111 runs from left to right along the document platen 106 at a constant velocity V. The second scanning unit 114 is controlled to scan in the same parallel direction at a velocity of V/2 based on the velocity V of the first scanning unit 111.

Consequently, the image of the document placed on the document platen 106 is sequentially focused and read onto the photoelectric converting element 116 on a line by line basis.

The image data obtained by reading the document image with the scanner unit 108 is sent to the above-mentioned image processing unit, and temporarily stored in a memory of the image processing unit after performing various processing. Then, the image in the memory is read according to an output instruction, and transferred to the image forming unit 101 to form the image on a sheet.

The image forming unit 101 comprises a transport system for a sheet that is a recording material for forming an image, a laser writing unit 117, and a photosensitive drum 118 for forming an image.

The laser writing unit 117 comprises a semiconductor laser for emitting laser light, according to image data which is read by the scanner unit 108, stored temporarily in the memory and then read from the memory, or image data transferred from an external device; a polygon mirror for deflecting the laser light at an equal angular velocity; and a f-θ lens for compensating the laser light deflected at the equal angular velocity so that it is deflected at an equal angular velocity on the photosensitive drum 118 that constitutes the image forming unit 101.

The image forming unit 101 comprises the known photosensitive drum 118, and a charger, a developer, a transfer unit, a remover, a cleaning unit and a charge eliminator disposed around the photosensitive drum 118.

On the other hand, the transport system for a sheet comprises a transport unit 119 for transporting a sheet to a transfer position where the transfer unit of the image forming unit 101 for forming an image is located; a multi-stage sheet feed unit 120 for feeding a sheet to the transport unit 119, or a manual sheet feeder 121 for appropriately feeding a sheet of a required size; a fixing device 122 for fixing an image, particularly a toner image formed on the sheet after the transfer operation; and a refeed path 123 for refeeding the sheet so as to form an image again on the back side of the sheet after the fixing operation.

Moreover, disposed on the downstream side of the fixing device 122 is a post-processing device for receiving a sheet with an image recorded thereon and performing predetermined processing on the sheet.

In the laser writing unit 117 and the image forming unit 101, the image data read from the image memory is formed as an electrostatic latent image on the surface of the photosensitive drum 118 by scanning a laser beam by the laser writing unit 117. A toner image obtained by visualizing this electrostatic latent image with toner is electrostatically transferred and fixed onto a surface of a sheet transported from any sheet feed unit of the multi-stage sheet feed unit.

The sheet with the image thus formed thereon is transported from the fixing device 122 to a post-processing unit 125 via ejection rollers 124.

FIG. 2 is an explanatory view showing a packing method for packing the image forming apparatus shown in FIG. 1 by a packing case.

When shipping the conventional image forming apparatus thus constructed, the image forming apparatus main body 103 and the toner cartridge 104 are separated and packed by a packing case 126 so as to prevent the image forming apparatus from being damaged by shock, etc.

The packing case 126 for packing the image forming apparatus main body 103 comprises a lower packing member 128 having a first recessed portion 127 corresponding to the lower outer shape of the image forming apparatus main body 103; two upper packing members 129, each having a recessed portion corresponding to the outer shape of an upper corner section of the image forming apparatus main body 103; and a cap-shaped packing member 130 which is to be fitted around the image forming apparatus main body 103. Further, a second recessed portion 131 corresponding to the outer shape of the toner cartridge 104 is provided on the outside of the above-mentioned first recessed portion 127 of the lower packing member 128.

Thus, the toner cartridge 104 which is packed together with the image forming apparatus main body 103 in the packing case 126 is stored and packed in the outside portion of the first recessed portion 127 of the lower packing member 128 for packing the image forming apparatus main body 103, in other words, in the second recessed portion 131 formed outside the packing area for the image forming apparatus main body 103.

FIG. 3 is a schematic view showing an example of the structure of a conventional small image forming apparatus, and FIG. 4 is an explanatory view showing a packing method for packing the image forming apparatus shown in FIG. 3 by a packing case.

As shown in FIG. 3, a main component of a recent digital image forming apparatus is an image forming apparatus main body 137 including a reading section 132 having a scanner portion for reading a document image; an image forming section 135 having an image forming unit 133 for forming an image according to image data read by the reading section 132, and a sheet feed unit 134 for feeding a sheet to the image forming unit 133; and a sheet storage space 136, formed to be open to the outside between the reading section 132 and the image forming section 135, for storing a sheet transported from the image forming unit 133. In addition, this image forming apparatus main body 137 has a toner cartridge 138 containing toner to be supplied to the image forming unit 133 and capable of being inserted into and removed from the image forming apparatus main body 137.

In this type of image forming apparatus, by forming the sheet storage space between the reading section and the image forming section and using this sheet storage space as a sheet output portion, the installation space of the image forming apparatus main body is reduced.

When shipping the conventional image forming apparatus thus constructed, the image forming apparatus main body 137 and the toner cartridge 138 are separated and packed by a packing case 137 so as to prevent the image forming apparatus from being damaged by shock, etc.

The packing case 139 for packing the image forming apparatus main body 137 comprises a lower packing member 141 having a third recessed portion 140 corresponding to the lower outer shape of the image forming apparatus main body 137; two upper packing members 142, each having a recessed portion corresponding to the outer shape of an upper corner portion of the image forming apparatus main body 137; and a box-shaped packing member 143 which is to be fitted around the image forming apparatus main body 137. Further, a fourth recessed portion 144 corresponding to the outer shape of the toner cartridge 138 is formed outside the above-mentioned third recessed portion 140 of the lower packing member 141.

Thus, the toner cartridge 138 which is to be packed together with the image forming apparatus main body 137 in the packing case 139 is stored and packed in the outside portion of the third recessed portion 140 of the lower packing member 141 for packing the image forming apparatus main body 137, in other words, in the fourth recessed portion 144 formed outside the packing area for the image forming apparatus main body 137.

However, in the image forming apparatus constructed as shown in FIG. 3, since the reading section 132 is in a floating state in the upper portion due to the sheet storage space 136, this image forming apparatus tends to be relatively weak against shock applied from an upper side compared to the conventional large image forming apparatus shown in FIG. 1. Therefore, in a digital image forming apparatus thus constructed, a shock absorbing material 145 is inserted into the sheet storage space 136 so as to reinforce the reading section 132 against shock and deformation during shipment.

Note that, for the packing of the toner cartridge 138, there may be an option to pack the toner cartridge 138 by a packing case different from the packing case 139 for the image forming apparatus main body 137, or an option to pack the toner cartridge 138 in a state in which the toner cartridge 138 is mounted inside the image forming apparatus main body 137.

However, in the case of the conventional image forming apparatus shown in FIG. 3, even when it is shipped in a state in which the photosensitive drum of the image forming unit 132 is mounted in the image forming apparatus main body 137, there is no particular problem. Whereas, when packing the image forming apparatus including the toner cartridge 138 mounted in the image forming apparatus main body 137, there is the advantage of achieving a reduction in the size of the packing case 139, but there is a fear that the toner may scatter in the image forming apparatus main body 137 due to vibration, etc. during shipment. Since the toner is fine particles, if the toner scatters in the image forming apparatus main body 137, a considerably long time is necessary for cleaning. In order to prevent this problem, it is necessary to provide an additional mechanism for sufficiently sealing the toner. Then, when the image forming apparatus reaches a user, the toner cartridge 138 must be removed from the image forming apparatus main body 137 once so as to release the sealing. After releasing the sealing of the removed cartridge 138, the user must attach the cartridge 138 again to the image forming apparatus main body 137.

In contrast, when packing the image forming apparatus main body 137 and the toner cartridge 138 separately, there is a less fear of the above-mentioned problem. However, since the number of packages for a single image forming apparatus increases, there is the problem of an increase in the shipment cost. Further, as shown in FIG. 2 and FIG. 4, in the conventional packing methods in which the recessed portions 131, 144 for packing the toner cartridges 104, 138 are formed outside the packing area for the image forming apparatus main bodies 103, 137, although sufficient shock resistance is provided, excessive packing is unavoidable as a large quantity of packing material is necessary, and thus there is the problem of high cost. In addition, since the overall volume of the packing case increases, there is also the problem of high shipment cost.

BRIEF SUMMARY OF THE INVENTION

The present invention has been made with the aim of solving the above problems, and the present invention provides a packing case capable of decreasing the overall size thereof and reducing the cost thereof by comprising a first packing member for packing an image forming apparatus main body, and a second packing member for packing a toner cartridge and to be inserted and fixed in a sheet storage space formed between a reading section and an image forming section.

Another aspect of the present invention is to provide a packing case capable of eliminating the necessity of using a shock absorbing member for use exclusively in the sheet storage space by comprising two second packing members for holding both end portions of the toner cartridge.

Still another aspect of the present invention is to provide a packing case capable of protecting the reading section and toner cartridge of the image forming apparatus from shock applied to the image forming apparatus during shipment by comprising the second packing member made of a shock absorbing material.

Yet another aspect of the present invention is to provide a packing case capable of protecting the toner cartridge entirely and increasing the rigidity for supporting the reading section by comprising the second packing member having a recessed storage portion for storing the toner cartridge.

A further aspect of the present invention is to provide a packing case capable of decreasing the overall size thereof and reducing the cost thereof by comprising a first packing member for packing an image forming apparatus main body from which a drum unit is removed, and a second packing member for storing and packing the drum unit and to be inserted and fixed in a sheet storage space.

A still further aspect of the present invention is to provide a packing method capable of decreasing the size thereof for an image forming apparatus and reducing the cost thereof by packing a toner cartridge by a packing member, and inserting and fixing the toner cartridge in a sheet storage space formed between a reading section and an image forming section.

Another aspect of the present invention is to provide a packing method capable of preventing toner in a toner cartridge from scattering in an image forming apparatus by inserting and fixing the packed toner cartridge in a sheet storage space after setting it into a state in which the toner does not leak out from an outlet.

Still another aspect of the present invention is to provide a packing method capable of preventing developer from mixing into toner in a toner container during the shipment of an image forming apparatus by packing a toner cartridge in a state in which the developer in a developer container does not flow into the toner container, and inserting and fixing the toner cartridge in a sheet storage space.

Yet another aspect of the present invention is to provide a packing method capable of decreasing the size thereof for an image forming apparatus and reducing the cost thereof by packing a drum unit by a packing member, and inserting and fixing the drum unit in a sheet storage space.

A further aspect of the present invention is to provide a packing method capable of decreasing the size thereof for an image forming apparatus and reducing the cost thereof by packing a photosensitive drum and a toner cartridge by a packing member, and inserting and fixing the photosensitive drum and the toner cartridge in a sheet storage space.

Still further aspect of the present invention is to provide an image forming apparatus capable of decreasing the overall size of the packing case and reducing the cost of the packing case by being constructed so as to be packed by the packing case comprising a first packing member for packing an image forming apparatus main body, and a second packing member for packing a toner cartridge and to be inserted and fixed in a sheet storage space formed between a reading section and an image forming section.

Another aspect of the present invention is to provide an image forming apparatus capable of eliminating the necessity of using a shock absorbing member for use exclusively in the sheet storage space by being constructed so that the toner cartridge is packed by two second packing members for holding both end portions thereof.

Still another aspect of the present invention is to provide an image forming apparatus capable of protecting the reading section and toner cartridge from shock applied thereto during shipment by being constructed so that the toner cartridge is packed by the second packing member made of a shock absorbing material.

Yet another aspect of the present invention is to provide an image forming apparatus capable of protecting the toner cartridge entirely and increasing the rigidity for supporting the reading section by being constructed so that the toner cartridge is packed by the second packing member having a recessed storage portion for storing the toner cartridge.

A further aspect of the present invention is to provide an image forming apparatus capable of decreasing the overall size of the packing case and reducing the cost of the packing case by being constructed so as to be packed by a packing case comprising the first packing member for packing in a state under which a drum unit is removed, and a second packing member for storing and packing the drum unit and to be inserted and fixed in a sheet storage space.

A first aspect of the packing case of the present invention for an image forming apparatus is a packing case for packing an image forming apparatus which comprises: an image forming apparatus main body including a reading section having a scanner unit for reading a document image, an image forming section having an image forming unit for forming an image according to image data read by the reading section and a sheet feed unit for feeding a sheet to the image forming unit, and a sheet storage space, formed to be open to outside between the reading section and the image forming section, for storing a sheet transported from the image forming unit; and a toner cartridge containing toner to be supplied to the image forming unit and capable of being inserted into and removed from the image forming apparatus main body, the packing case comprising: a first packing member for packing the image forming apparatus main body; and a second packing member for packing the toner cartridge and to be inserted and fixed in the sheet storage space.

According to the first aspect of the packing case of the present invention for an image forming apparatus, since the second packing member for packing the toner cartridge is inserted and fixed in the sheet storage space, it is possible to decrease the overall size of the packing case and reduce the cost of the packing case.

A second aspect of the packing case of the present invention for an image forming apparatus is a packing case based on the first aspect of the packing case of the present invention, wherein the second packing member is composed of two pieces for holding both end portions of the toner cartridge, respectively.

According to the second aspect of the packing case of the present invention for an image forming apparatus, in the first aspect of the packing case of the present invention, since the reading section can be supported at two positions of the sheet storage space, there is no need to provide a shock absorbing member for use exclusively in the sheet storage space.

A third aspect of the packing case of the present invention for an image forming apparatus is a packing case based on the first or second aspect of the packing case of the present invention, wherein the second packing member is made of a shock absorbing material.

According to the third aspect of the packing case of the present invention for an image forming apparatus, in the first or second aspect of the packing case of the present invention, it is possible to increase the resistance of the second packing member against shock and to protect the reading section and toner cartridge of the image forming apparatus from shock applied to the image forming apparatus during shipment.

A fourth aspect of the packing case of the present invention for an image forming apparatus is a packing case based on any one of the first through third aspects of the packing case of the present invention, wherein the second packing member has a recessed storage portion for storing the toner cartridge.

According to the fourth aspect of the packing case of the present invention for an image forming apparatus, in any one of the first through third aspects of the packing case of the present invention, since the toner cartridge is stored in the recessed storage portion of the second packing member, it is possible to protect the toner cartridge entirely and increase the rigidity for supporting the reading section.

A fifth aspect of the packing case of the present invention for an image forming apparatus is a packing case for packing an image forming apparatus which comprises: a reading section having a scanner unit for reading a document image; an image forming section having an image forming unit for forming an image on a photosensitive drum, according to image data read by the reading section, and a sheet feed unit for feeding a sheet to the image forming unit; a sheet storage space, formed to be open to outside between the reading section and the image forming section, for storing a sheet transported from the image forming unit; and a drum unit incorporating the photosensitive drum and a toner container containing toner to be supplied to the photosensitive drum as a unit and capable of being inserted into and removed from the image forming section, the packing case comprising: a first packing member for packing the image forming apparatus from which the drum unit is removed; and a second packing member for storing and packing the drum unit and to be inserted and fixed in the sheet storage space.

According to the fifth aspect of the packing case of the present invention for an image forming apparatus, since the second packing member for packing the drum unit is inserted and fixed in the sheet storage space, it is possible to decrease the overall size of the packing case and reduce the cost of the packing case. Moreover, since the second packing member is inserted and fixed in the sheet storage space, this second packing member can support the reading section of the image forming apparatus and a shock absorbing member for use exclusively in the sheet storage space is unnecessary, thereby improving the packing performance.

A first aspect of the packing method of the present invention for an image forming apparatus is a packing method for packing by a packing case an image forming apparatus which comprises: a reading section having a scanner unit for reading a document image; an image forming section having an image forming unit for forming an image according to image data read by the reading section and a sheet feed unit for feeding a sheet to the image forming unit; a sheet storage space, formed to be open to outside between the reading section and the image forming section, for storing a sheet transported from the image forming unit; and a toner cartridge containing toner to be supplied to the image forming unit and capable of being inserted into and removed from the image forming section, the method comprising the steps of packing the toner cartridge by a packing member; and inserting and fixing the packed toner cartridge in the sheet storage space.

According to the first aspect of the packing method of the present invention for an image forming apparatus, since the packed toner cartridge is inserted and fixed in the sheet storage space, it is possible to effectively use the sheet storage space where no sheet is stored at the time of packing, thereby achieving a decrease in the size of the packing case for the image forming apparatus and a reduction in the cost of the packing case. In addition, the reading section of the image forming apparatus can be supported by the toner cartridge inserted and fixed in the sheet storage space, and a shock absorbing material for use exclusively in the sheet storage space is unnecessary, thereby improving the packing performance.

A second aspect of the packing method of the present invention for an image forming apparatus is a packing method based on the first aspect of the packing method of the present invention, wherein the toner cartridge has a toner container and an outlet for discharging toner in the toner container out of the toner container, and the method further comprises the steps of: making the toner to be in a state under which the toner container not to leak out from the outlet; and then inserting and fixing the packed toner cartridge in the sheet storage space.

According to the second aspect of the packing method of the present invention for an image forming apparatus, in the first aspect of the packing method of the present invention, since the toner cartridge is inserted and fixed in the sheet storage space in a state under which the toner does not leak out from the outlet of the toner container, it is possible to prevent the toner in the toner cartridge from scattering in the image forming apparatus.

A third aspect of the packing method of the present invention for an image forming apparatus is a packing method based on the first aspect of the packing method of the present invention, wherein the toner cartridge has a developer container and a toner container connected to the developer container, and the method further comprises the steps of: packing the toner cartridge in a state under which developer in the developer container does not flow into the toner container; and inserting and fixing the packed toner cartridge in the sheet storage space.

According to the third aspect of the packing method of the present invention for an image forming apparatus, in the first aspect of the packing method of the present invention, since the toner cartridge is packed in a state under which the developer in the developer container does not flow into the toner container, it is possible to prevent the developer from mixing into the toner in the toner container during the shipment of the image forming apparatus.

A fourth aspect of the packing method of the present invention for an image forming apparatus is a packing method for packing by a packing case an image forming apparatus which comprises: a reading section having a scanner unit for reading a document image; an image forming section having an image forming unit for forming an image on a photosensitive drum, according to image data read by the reading section, and a sheet feed unit for feeding a sheet to the image forming unit; a sheet storage space, formed to be open to outside between the reading section and the image forming section, for storing a sheet transported from the image forming unit; and a drum unit incorporating the photosensitive drum and a toner container containing toner to be supplied to the photosensitive drum as a unit and capable of being inserted into and removed from the image forming section, the method comprising the steps of packing the drum unit by a packing member; and inserting and fixing the packed drum unit in the sheet storage space.

According to the fourth aspect of the packing method of the present invention for an image forming apparatus, since the packed drum unit is inserted and fixed in the sheet storage space, it is possible to effectively use the sheet storage space where no sheet is stored at the time of packing, thereby achieving a decrease in the size of the packing case for the image forming apparatus and a reduction in the cost of the packing case. In addition, the reading section of the image forming apparatus can be supported by the drum unit inserted and fixed in the sheet storage space, and a shock absorbing material for use exclusively in the sheet storage space is unnecessary, thereby improving the packing performance.

A fifth aspect of the packing method of the present invention for an image forming apparatus is a packing method for packing by a packing case an image forming apparatus which comprises: a reading section having a scanner unit for reading a document image; an image forming section having an image forming unit for forming an image on a photosensitive drum, according to image data read by the reading section, and a sheet feed unit for feeding a sheet to the image forming unit; a sheet storage space, formed to be open to outside between the reading section and the image forming section, for storing a sheet transported from the image forming unit; and a toner cartridge containing toner to be supplied to the image forming unit and capable of being inserted into and removed from the image forming section, wherein the photosensitive drum is insertable into and removable from the image forming section, the method comprising the steps of packing the photosensitive drum and the toner cartridge by a packing member; and inserting and fixing the packed photosensitive drum and toner cartridge in the sheet storage space.

According to the fifth aspect of the packing method of the present invention for an image forming apparatus, since the packed photosensitive drum and toner cartridge are inserted and fixed in the sheet storage space, it is possible to effectively use the sheet storage space where no sheet is stored at the time of packing, thereby achieving a decrease in the size of the packing case for the image forming apparatus and a reduction in the cost of the packing case. In addition, the reading section of the image forming apparatus can be supported by the photosensitive drum and toner cartridge inserted and fixed in the sheet storage space, and a shock absorbing material for use exclusively in the sheet storage space is unnecessary, thereby improving the packing performance.

A first aspect of the image forming apparatus of the present invention is an image forming apparatus comprising: an image forming apparatus main body including a reading section having a scanner unit for reading a document image, an image forming section having an image forming unit for forming an image according to image data read by the reading section and a sheet feed unit for feeding a sheet to the image forming unit, and a sheet storage space, formed to be open to outside between the reading section and the image forming section, for storing a sheet transported from the image forming unit; and a toner cartridge containing toner to be supplied to the image forming unit and capable of being inserted into and removed from the image forming apparatus main body, wherein the image forming apparatus main body is packed by a first packing member; and the toner cartridge is packed by a second packing member being formed to be inserted and fixed in the sheet storage space of the image forming apparatus main body packed by the first packing member, and is inserted and fixed in the sheet storage space.

According to the first aspect of the image forming apparatus, since the image forming apparatus main body is packed by a first packing member and the toner cartridge packed by the second packing member formed to be inserted and fixed in the sheet storage space of the image forming apparatus main body packed by the first packing member, it is possible to decrease the overall size of the packing case and reduce the cost of the packing case.

A second aspect of the image forming apparatus of the present invention is an image forming apparatus based on the first aspect of the image forming apparatus of the present invention, wherein the second packing member is composed of two pieces for holding both end portions of the toner cartridge, respectively.

According to the second aspect of the image forming apparatus of the present invention, in the first aspect of the image forming apparatus of the present invention, since the reading section can be supported at two positions of the sheet storage space, there is no need to provide a shock absorbing member for use exclusively in the sheet storage space.

A third aspect of image forming apparatus of the present invention is an image forming apparatus based on the first or second aspect of the image forming apparatus of the present invention, wherein the second packing member is made of a shock absorbing material.

According to the third aspect of the image forming apparatus of the present invention, in the first or second aspect of the image forming apparatus of the present invention, it is possible to increase the resistance of the second packing member against shock and to protect the reading section and toner cartridge of the image forming apparatus from shock applied to the image forming apparatus during shipment.

A fourth aspect of the image forming apparatus of the present invention is an image forming apparatus based on any one of the first through third aspects of the image forming apparatus of the present invention, wherein the second packing member has a recessed storage portion for storing the toner cartridge.

According to the fourth aspect of the image forming apparatus of the present invention, in any one of the first through third aspects of the image forming apparatus of the present invention, since the toner cartridge is stored in the recessed storage portion of the second packing member, it is possible to protect the toner cartridge entirely and increase the rigidity for supporting the reading section.

A fifth aspect of the image forming apparatus of the present invention is an image forming apparatus comprising: a reading section having a scanner unit for reading a document image; an image forming section having an image forming unit for forming an image on a photosensitive drum, according to image data read by the reading section, and a sheet feed unit for feeding a sheet to the image forming unit; a sheet storage space, formed to be open to outside between the reading section and the image forming section, for storing a sheet transported from the image forming unit; and a drum unit incorporating the photosensitive drum and a toner container containing toner to be supplied to the photosensitive drum as a unit and capable of being inserted into and removed from the image forming section, the image forming apparatus being packed by a first packing member in a state under which the drum unit is removed, and the drum unit being packed by a second packing member being formed to be inserted and fixed in the sheet storage space, and is inserted and fixed in the sheet storage space in the packed state by the first packing member.

According to the fifth aspect of the image forming apparatus of the present invention, since the second packing member for packing the drum unit is inserted and fixed in the sheet storage space, it is possible to decrease the overall size of the packing case and reduce the cost of the packing case. Moreover, since the second packing member is inserted and fixed in the sheet storage space, this second packing member can support the reading section and a shock absorbing member for use exclusively in the sheet storage space is unnecessary, thereby improving the packing performance.

The above and further aspects and features of the invention will more fully be apparent from the following detailed description with accompanying drawings.

DETAILED DESCRIPTION OF THE PRESENT INVENTION

The following description will explain the present invention in detail, based on the drawings illustrating some embodiments thereof.

Figure 5:
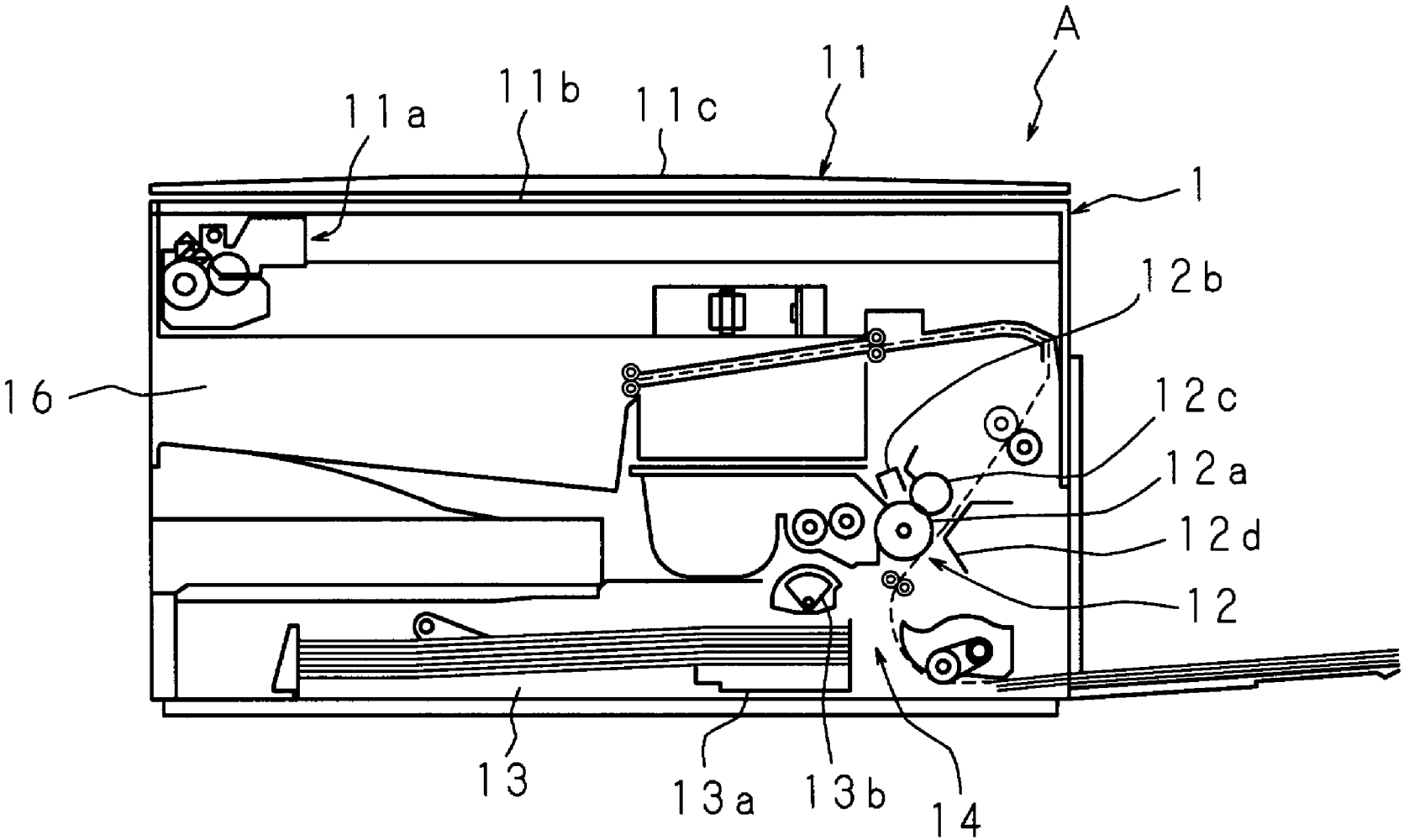
FIG. 5 is a schematic view showing the structure of an image forming apparatus of the present invention to be packed by a packing case of the present invention.

FIG. 5 is a schematic view showing the structure of an image forming apparatus of the present invention to be packed by a packing case of the present invention.

As shown in FIG. 5, this image forming apparatus A comprises a reading section 11 having a scanner unit 11*a* for reading a document image; an image forming unit 12 for forming an image according to image data read by the reading section 11; and a sheet feed unit 13 for feeding a sheet to the image forming unit 12. The reading section 11 and the sheet feed unit 13 are disposed to face each other with a space therebetween in upward and downward directions, and the image forming unit 12 is disposed on one end portion side of the space between the facing reading section 11 and the sheet feed unit 13. The image forming unit 12 and the sheet feed unit 13 constitute an image forming section 14. Besides, on the other end portion side of the space between the facing reading section 11 and the sheet feed unit 13, a sheet storage space 16 for storing a sheet transported from the image forming unit 12 is formed to be open to the outside. This sheet storage space 16 is open in a sheet transport direction and a side direction crossing the transport direction.

These reading section 11, image forming section 14, and sheet storage space 16 form an image forming apparatus main body 1. Moreover, this image forming apparatus main body 1 and a toner cartridge 2 (see FIG. 6), which contains toner to be supplied to the image forming unit 12 and can be inserted into and removed from the image forming apparatus main body 1, form the image forming apparatus A.

The reading section 11 includes a document platen 11*b* made of a transparent glass, an automatic double-sided document feeder (ADF) 11*c* for automatically feeding and transporting a document onto the document platen 11*b*, and the scanner unit 11*a* for reading an image of a document placed on the document platen 11*b* by scanning.

The image forming unit 12 comprises a photosensitive drum 12*a*; a charger 12*b* for uniformly charging the surface of the photosensitive drum 12*a*; an optical scanning unit (not shown) for writing an electrostatic latent image on the uniformly charged photosensitive drum 12*a* by scanning a light image; a developer unit 12*c* for developing the electrostatic latent image written by the optical scanning unit by visualizing it with a developer; a transfer unit 12*d* for transferring the electrostatic latent image reproduced on the photosensitive drum 12*a* to a sheet; a cleaning unit (not shown) for removing the developer remaining on the photosensitive drum 12*a* so as to allow the photosensitive drum 12*a* to write a new electrostatic latent image; and a charge eliminator (not shown) for removing the charge on the surface of the photosensitive drum 12*a*.

The sheet feed unit 13 includes a tray 13*a* which holds a plurality of sheets and is supported so that its one end portion can be moved up and down, and a pickup roller 13*b* which is disposed above the tray 13*a* and picks up a topmost sheet at a time from the tray 13*a* and feeds it to the photosensitive drum 12*a*.

Figure 6:
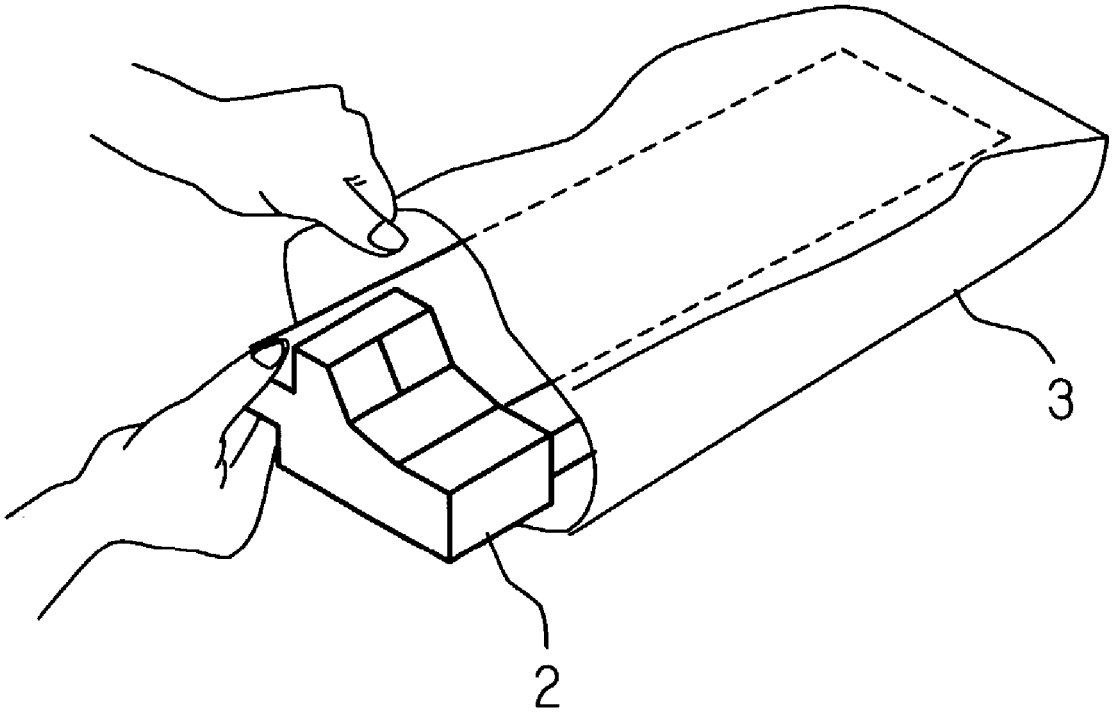
FIG. 6 is an explanatory view showing a state of the packing case of the present invention in which a toner cartridge is stored in a storage bag.

The toner cartridge 2 has a toner container, and an outlet for discharging toner in the toner container to the outside. FIG. 6 is an explanatory view showing the state of storing the toner cartridge in a storage bag. As shown in FIG. 6, in order to prevent the toner in the toner container from leaking out from the outlet and polluting the periphery due to shock and vibration during shipment, the toner cartridge 2 is stored in the storage bag 3 made of a polyethylene sheet, etc. By fastening the storage back by a method such as heat sealing to improve the sealing performance of the storage bag 3, it is also possible to intercept moisture during shipment. If the sealing performance is too high, the air in the storage bag 3 may expand and break the storage bag 3 in regions of low atmospheric pressure such as highlands. It is possible to prevent such a problem by selecting a material having air permeability for the material of the storage bag 3. Furthermore, in order to intercept light, aluminum-deposited or -laminated material may be used for the storage bag 3. In addition to the method of storing the toner cartridge 2 in the storage bag 3, there is another method in which only the opening of the toner cartridge 2 is heat sealed or laminated with a sheet.

Figure 7:
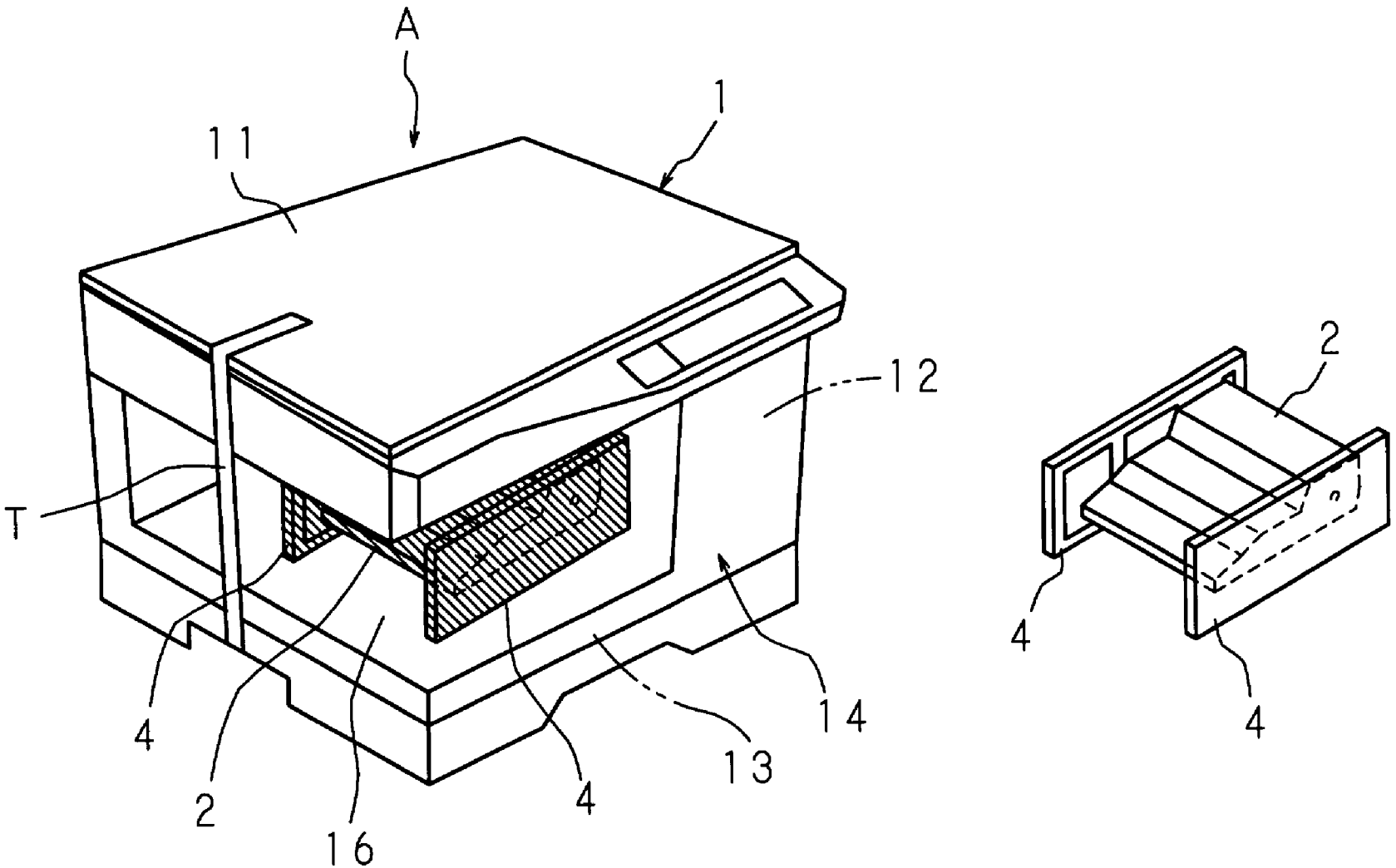
FIG. 7 is an explanatory view showing second packing members of the packing case of the present invention for packing a toner cartridge, and a packing method.

FIG. 7 is an explanatory view showing second packing members for packing the toner cartridge, and a packing method.

As shown in FIG. 7, both end portions of the toner cartridge 2 having the thus sealed outlet, which are to be the front and rear sides when attached to the image forming apparatus main body 1, are packed by second packing members 4. Each of the second packing members 4 is made of a shock absorbing material having a recessed portion corresponding to the shape of each of the two end portions of the cartridge 2, and prevents damage to the toner cartridge 2 by absorbing shock applied from the outside of the toner cartridge 2.

The toner cartridge 2 packed by the second packing members 4 are inserted into the sheet storage space 16 from the front side of the image forming apparatus main body 1 and fixed so that its front and rear end portions become the front and rear positions of the image forming apparatus main body 1. In order to prevent displacement of the second packing members 4 inserted and fixed in such a manner, the second packing members 4 are formed to have an outer shape corresponding to the inner shape of the sheet storage space 16. As shown in FIG. 7, in order to prevent the second packing members 4 and toner cartridge 2 inserted and fixed in the sheet storage space 16 from coming out, the image forming section 14 and the reading section 11 may be taped with a tape T. The second packing members 4 inserted and fixed in the sheet storage space 16 absorb shock applied from the upper side of the reading section 11, and prevent damage to the reading section 11. In short, the second packing members 4 protect the toner cartridge 2 packed inside and also the outside reading section 11.

Figure 8:
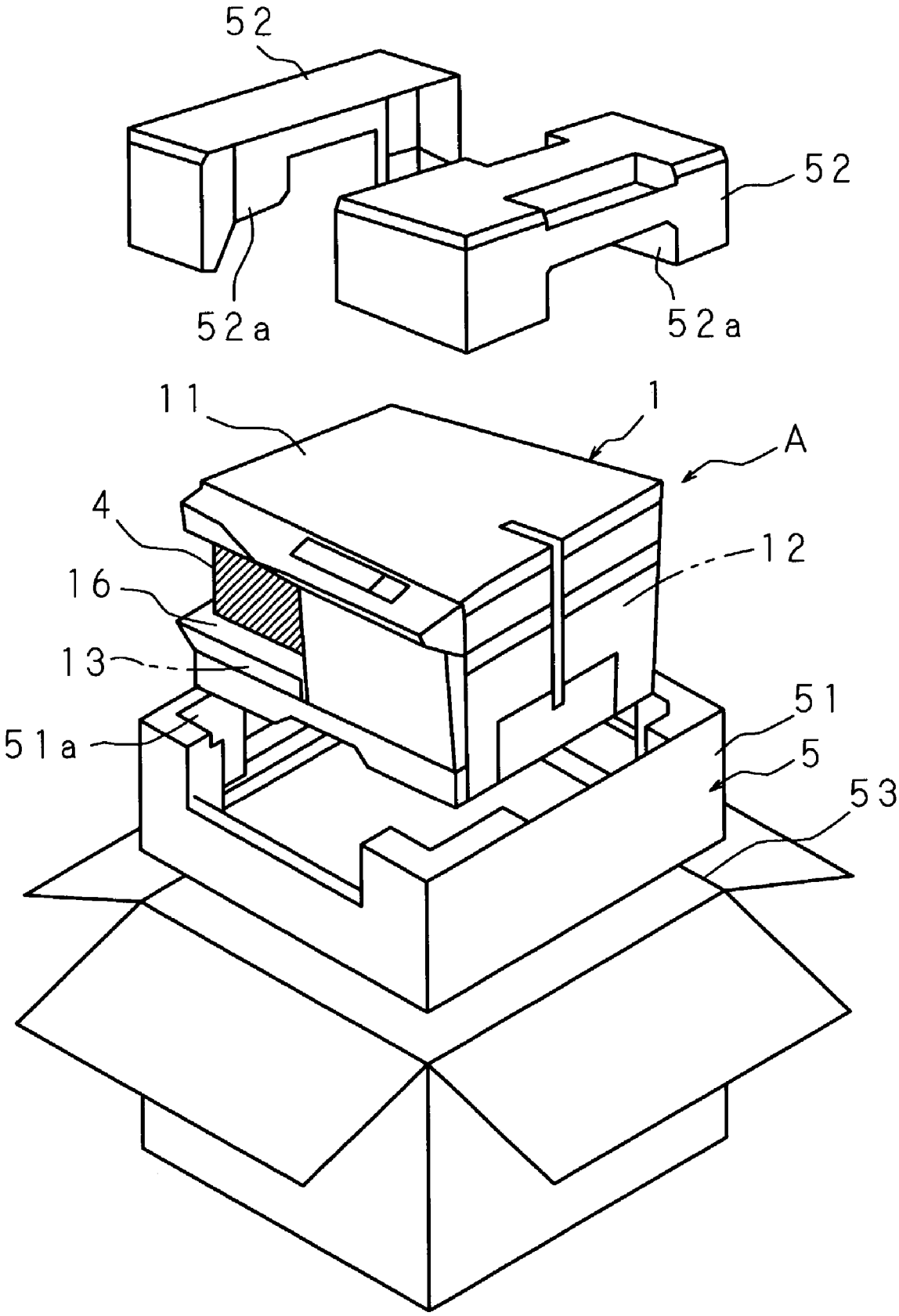
FIG. 8 is an explanatory view showing second packing members for packing the image forming apparatus of the present invention, and a packing method.

FIG. 8 is an explanatory view showing the second packing members for packing the image forming apparatus, and the packing method.

As shown in FIG. 8, the image forming apparatus main body 1 in which the toner cartridge 2 packed by the second packing members 4 is inserted and fixed in the sheet storage space 16 is packed by a first packing member 5. The first packing member 5 comprises a Lower packing member 51 having a recessed portion 51*a* corresponding to the lower outer shape of the image forming apparatus main body 1; two upper packing members 52, each having a recessed portion 52*a* corresponding to the upper outer shape of the image forming apparatus main body 1; and a box-shaped packing member 53 for storing and boxing the entire image forming apparatus main body 1.

Figure 1:
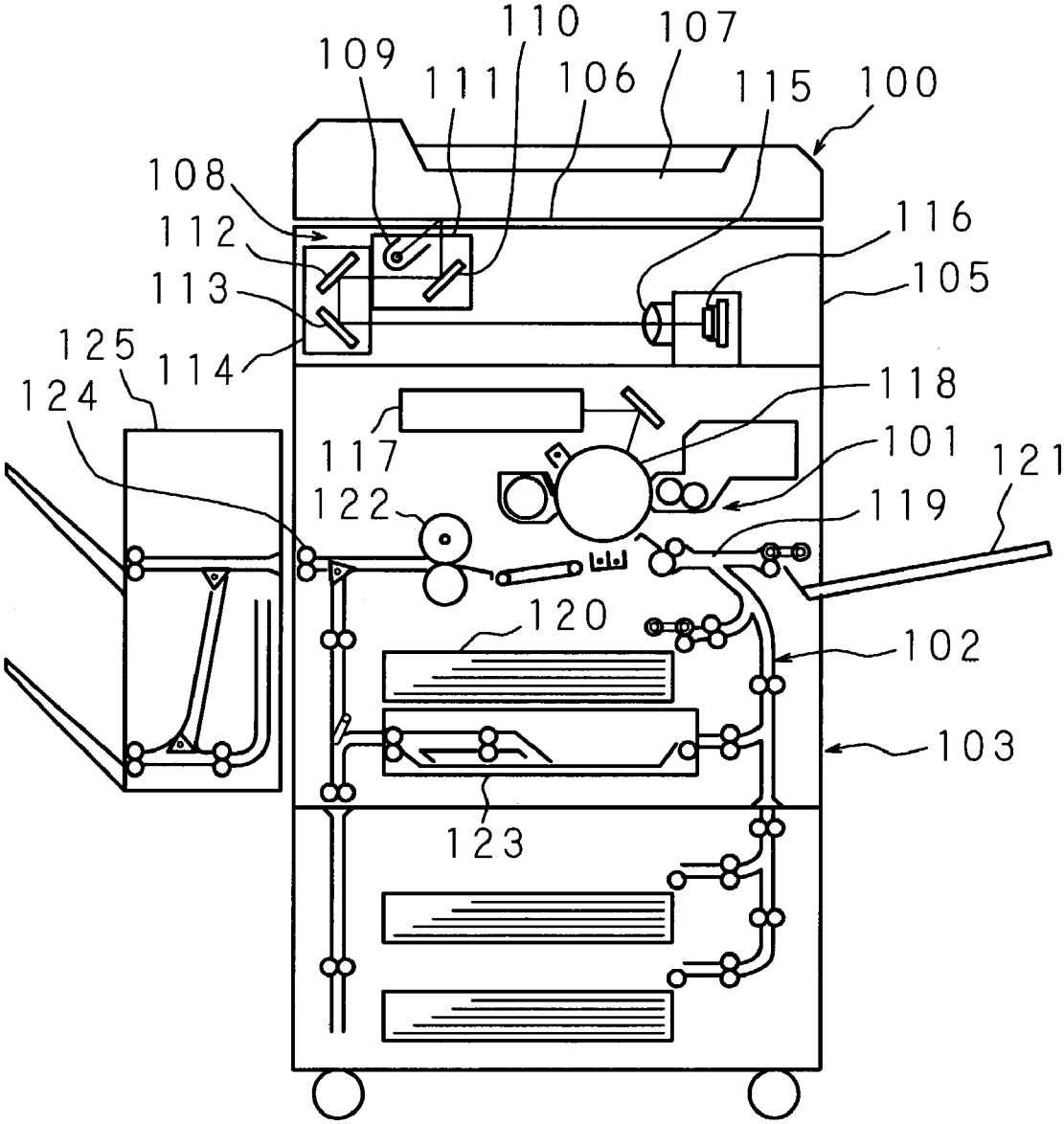
FIG. 1 PRIOR ART
FIG. 1 is a schematic view showing the structure of a conventional large image forming apparatus.
Figure 2:
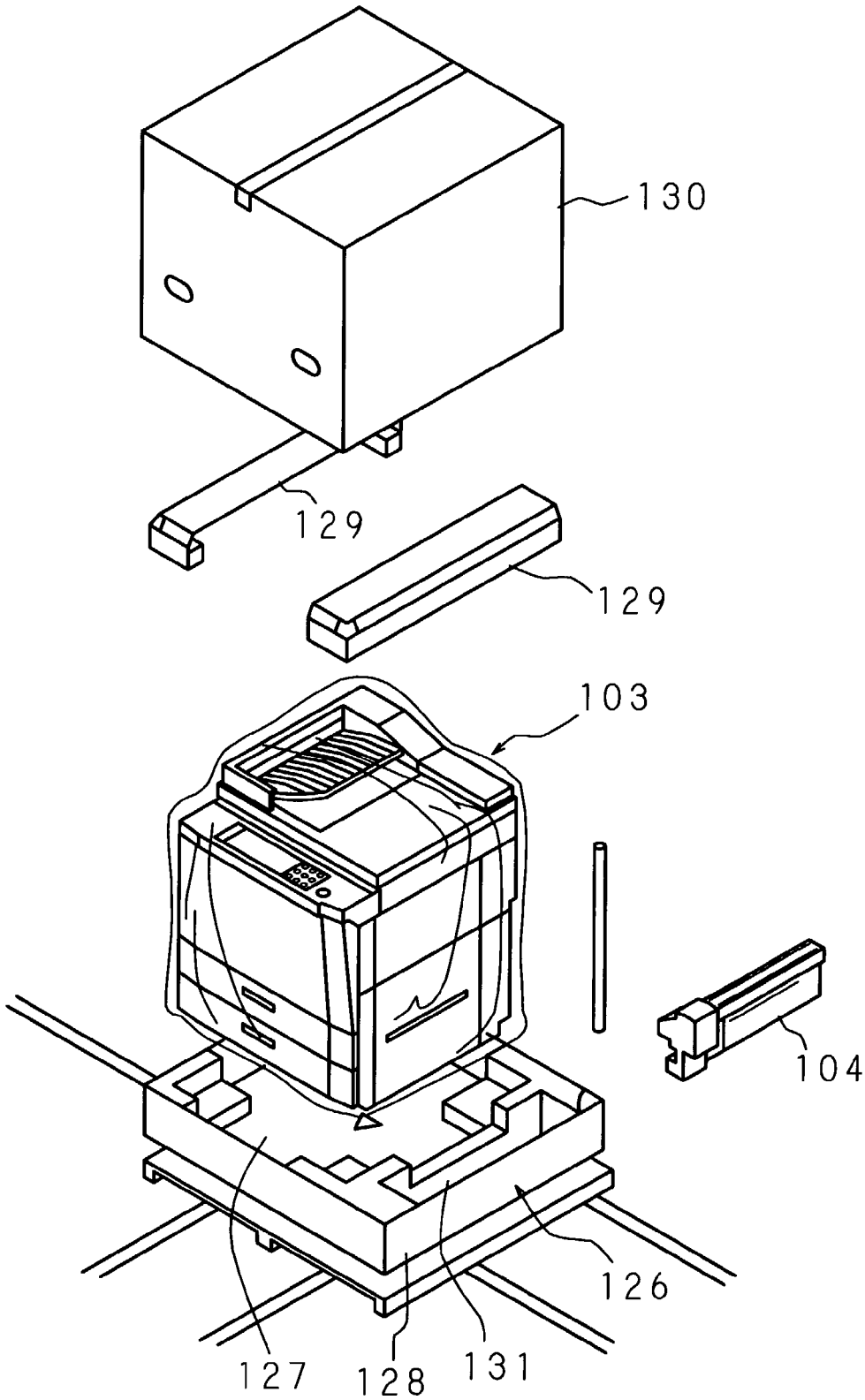
FIG. 2 PRIOR ART
FIG. 2 is an explanatory view showing a packing method for packing the image forming apparatus shown in FIG. 1 by a packing case.
Figure 3:
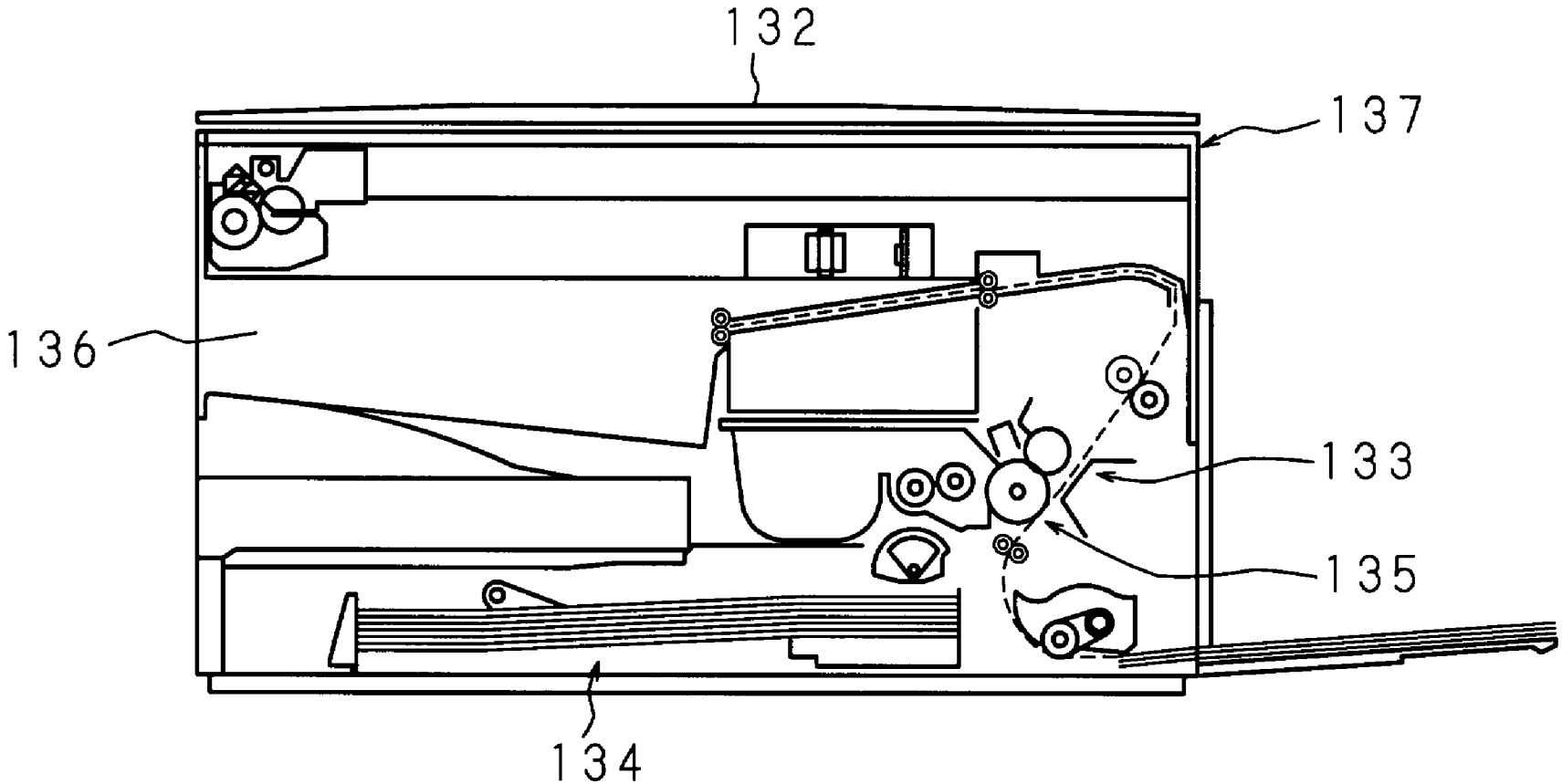
FIG. 3 PRIOR ART
FIG. 3 is a schematic view showing the structure of a conventional small image forming apparatus.
Figure 4:
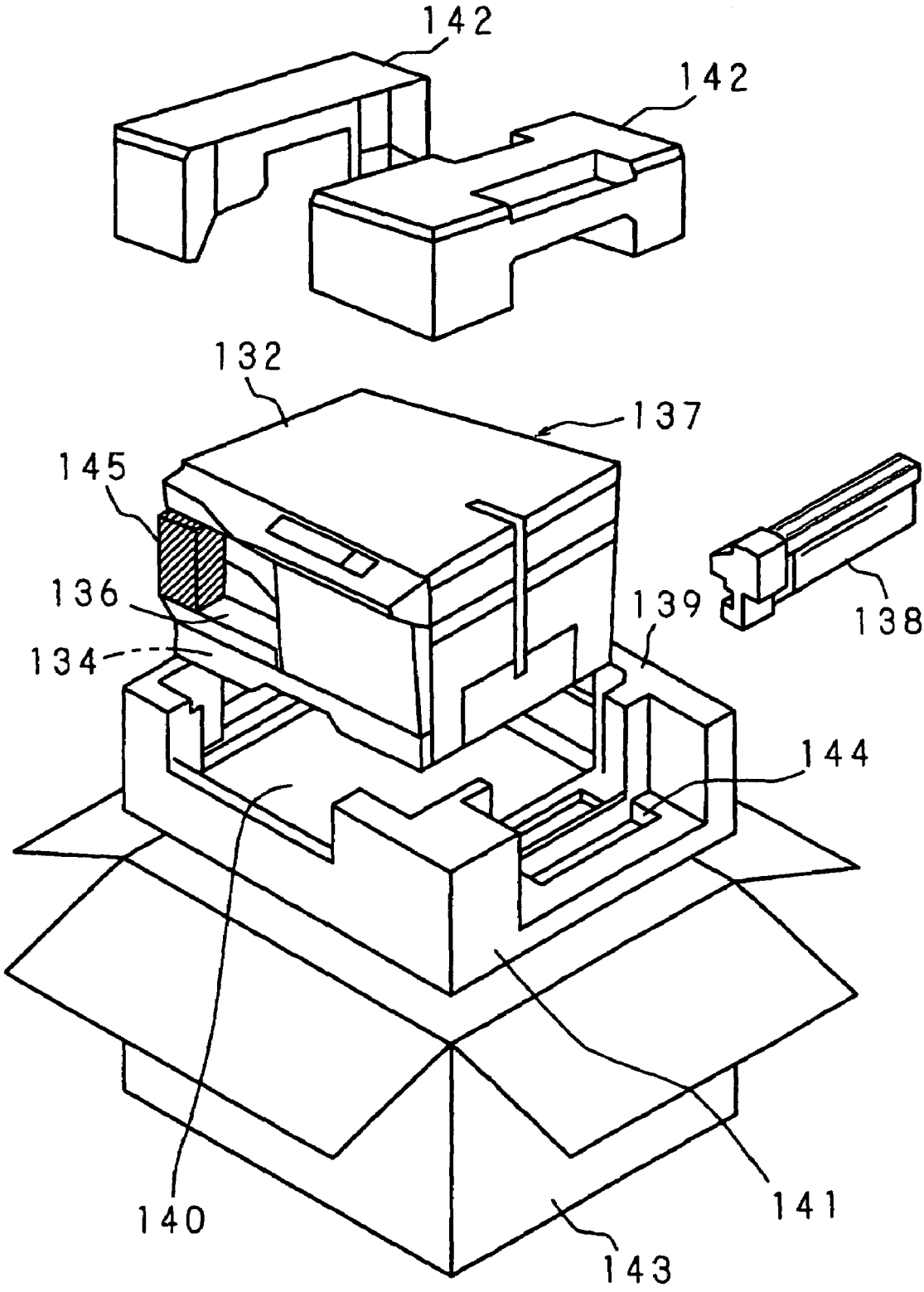
FIG. 4 PRIOR ART
FIG. 4 is an explanatory view showing a packing method for packing the image forming apparatus shown in FIG. 3 by a packing case.

Thus, by packing the image forming apparatus main body 1 by the first packing case 5, it is possible to decrease the size of the first packing case 5 for the image forming apparatus main body 1 and reduce the cost compared with the conventional packing case and packing method shown in FIG. 2 and FIG. 4 which have a packing portion for packing the toner cartridge outside the packing area for the image forming apparatus main body 1 and store the toner cartridge in this packing portion. Moreover, with the packing member 5 that performs both the functions of supporting the reading section 11 and fixing and protecting the toner cartridge 2 by inserting and fixing the toner cartridge 2 in the sheet storage space 16 of the image forming apparatus main body 1, a shock absorbing material for use exclusively in the sheet storage space is unnecessary, which is required by the conventional structure, thereby achieving a decrease in the number of parts and a reduction in the cost.

Note that, in FIG. 7, both end portions of the toner cartridge 2 which are to be the front and rear sides when attached to the image forming apparatus main body 1 are packed by the second packing cases 4, but, for example, the left and right side portions of the toner cartridge 2, or the upper and lower side portions of the toner cartridge 2 may be packed instead. Further, although the packed toner cartridge 2 is inserted from the front side of the image forming apparatus main body 1 into the sheet storage space 16 and fixed, the toner cartridge 2 may instead be inserted into the sheet storage space 16 from a side or the rear side of the image forming apparatus main body 1 and fixed. In addition, instead of inserting and fixing the toner cartridge 2 so that its front and rear end portions come to the front and rear end positions of the image forming apparatus main body 1, the toner cartridge 2 may be inserted and fixed in the sheet storage space 16 so that its front and rear end portions come to the left and right positions (in a sheet transport direction) of the image forming apparatus main body 1.

Figure 9:
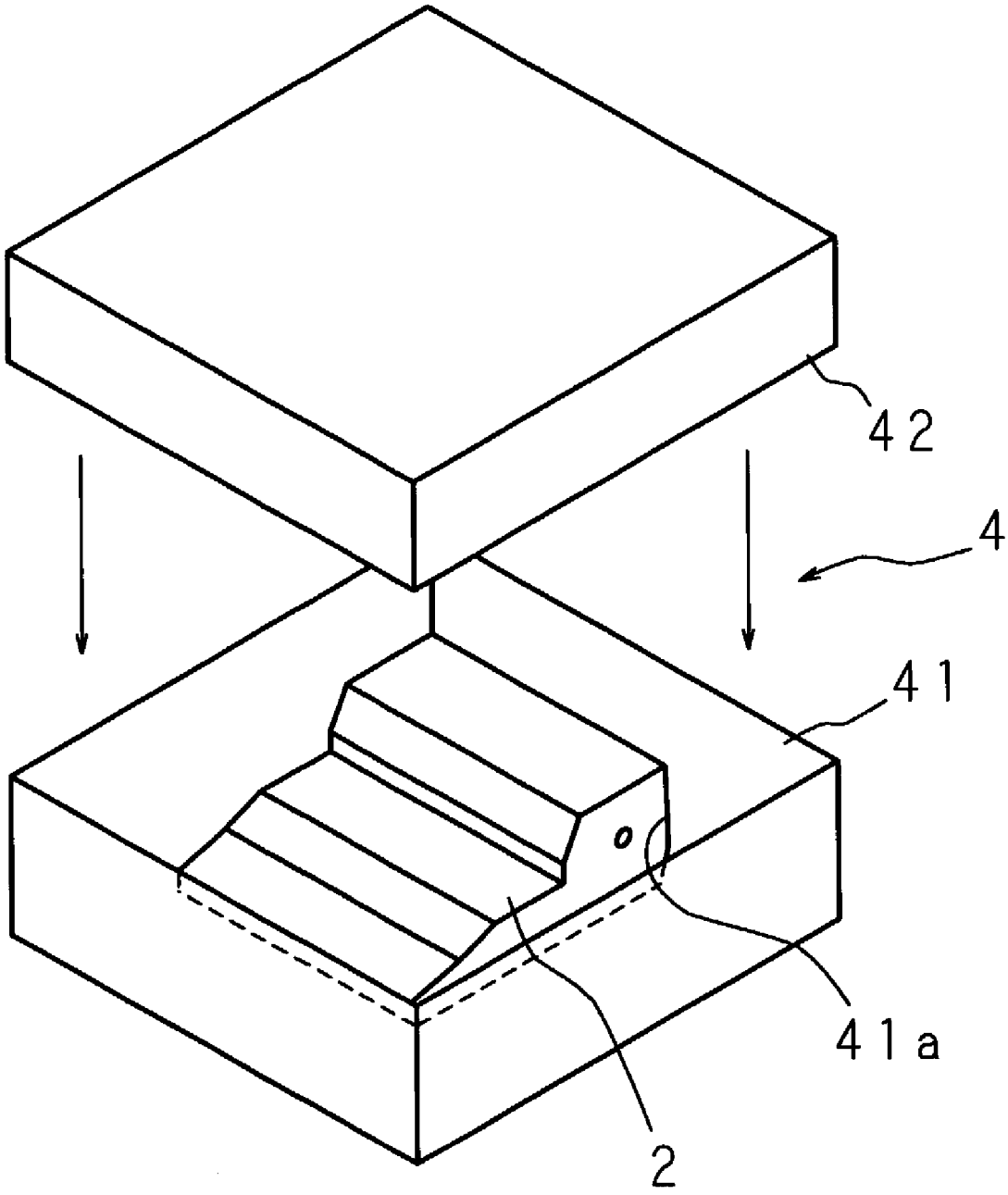
FIG. 9 is an explanatory view showing the structure of another packing member for packing a toner cartridge.

FIG. 9 is an explanatory view showing another example of the structure of the second packing member for packing the toner cartridge 2.

Instead of the above-mentioned structure in which the second packing members 4 pack the front and rear end portions of the toner cartridge 2, the second packing member 4 may be constructed to have a recessed storage portion 41*a* for storing the entire toner cartridge 2 as shown in FIG. 9. The second packing member 4 shown in FIG. 9 is composed of a box member 41 made from a shock absorbing material, and a lid member 42 for closing the upper opening of the box member 41. However, as an alternative structure, for example, the second packing member 4 may be composed only of the box member 41 without the lid member 42. When the second packing member 4 is constructed in this way, although an increased amount of packing material is necessary compared to packing a part of the toner cartridge 2 by the above-mentioned two second packing members 4, this structure can absorb the largest amount of external shock.

By the way, as the developer contained in the toner cartridge 2, there are one-component magnetic developer composed of magnetic toner; one-component non-magnetic developer composed of non-magnetic toner; and two-component developer composed of non-magnetic toner and magnetic carrier, and a material for the developer sleeve is selected according to the developer to be used. As the magnetic developer for use in a magnetic brush method, the two-component developer that is a mixture of ferromagnetic carrier and toner particles is often used.

The ferroelectric magnetic carrier is an iron powder, ferrite powder, nickel powder, or one obtained by coating such powder with an organic polymer, while the toner particles are obtained by dispersing an additive such as a pigment and dye into a resin.

Figure 10:
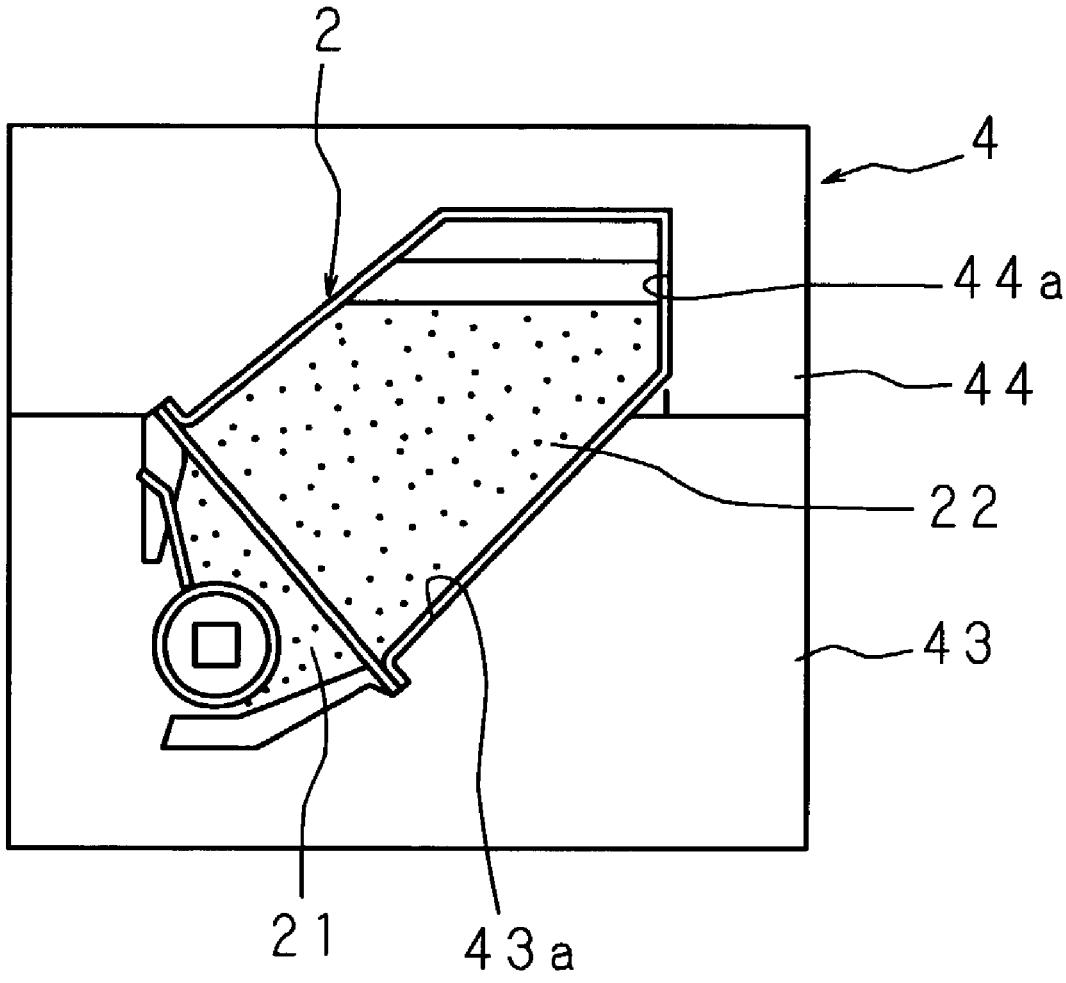
FIG. 10 is an explanatory view of an example in which another toner cartridge is packed by the packing case of the present invention.
Figure 11:
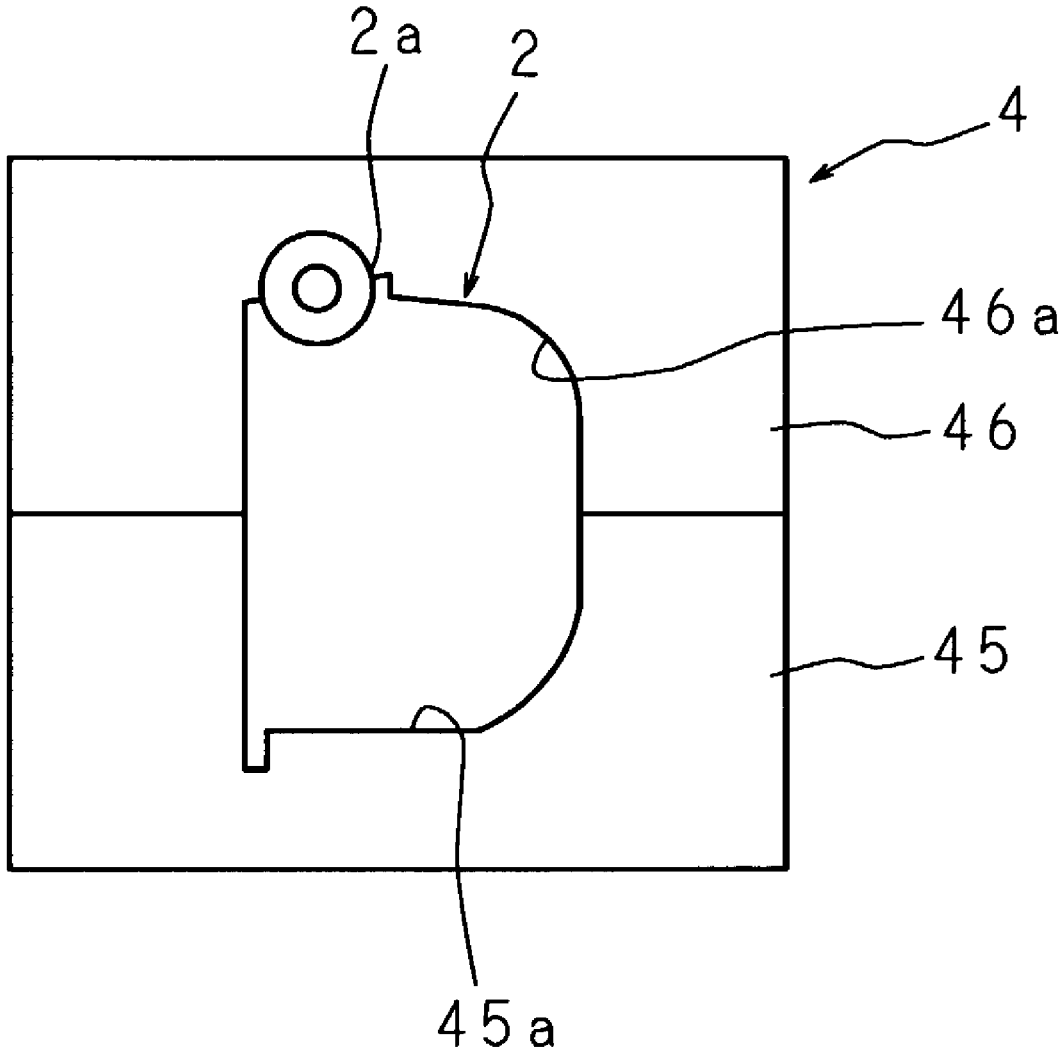
FIG. 11 is an explanatory view showing an example in which other toner cartridge is packed by the packing case of the present invention.

FIG. 10 and FIG. 11 are explanatory views for packing another toner cartridge having a structure different from those mentioned above.

When packing the above-described two-component developer and toner together, as shown in FIG. 10, a toner cartridge 2 having a developer container 21 containing the two-component developer and a toner container 22 connected to the developer container 21 and containing the toner is used. The second packing member 4 for packing such a toner cartridge 2 is composed of a box member 43 having a recessed storage portion 43*a* for storing the lower portion of the toner cartridge 2 and a lid member 44 having a recessed storage portion 44*a* for storing the upper portion of the toner cartridge 2, and the entire toner cartridge 2 is stored in these two recessed storage portions 43*a* and 44*a*. In this case, the toner cartridge 2 is packed by placing the toner container 22 in a higher position than the developer container 21 so that the developer in the developer container 21 does not flow into the toner container 22. The reason for this is that since the developer has a greater specific gravity than the toner, if the developer is placed in a higher position, there is a fear that the developer may mix into the toner due to vibration, etc.

However, in the case of a toner cartridge 2 having only the toner container 22 containing toner, it is preferable that the outlet 2*a* is positioned on the upper side as shown in FIG. 11. By positioning the toner cartridge 2 in this manner, it is possible to prevent scattering of the toner due to vibration, etc. Note that the second packing member 4 for packing the toner cartridge 2 shown in FIG. 11 is composed of a box member 45 having a recessed storage portion 45*a* for storing the upper portion of the toner cartridge 2 and a lid member 46 having a recessed storage portion 46*a* for storing the lower portion of the toner cartridge 2, and the entire toner cartridge 2 is stored in these two recessed storage portions 45*a* and 46*a*.

Figure 12:
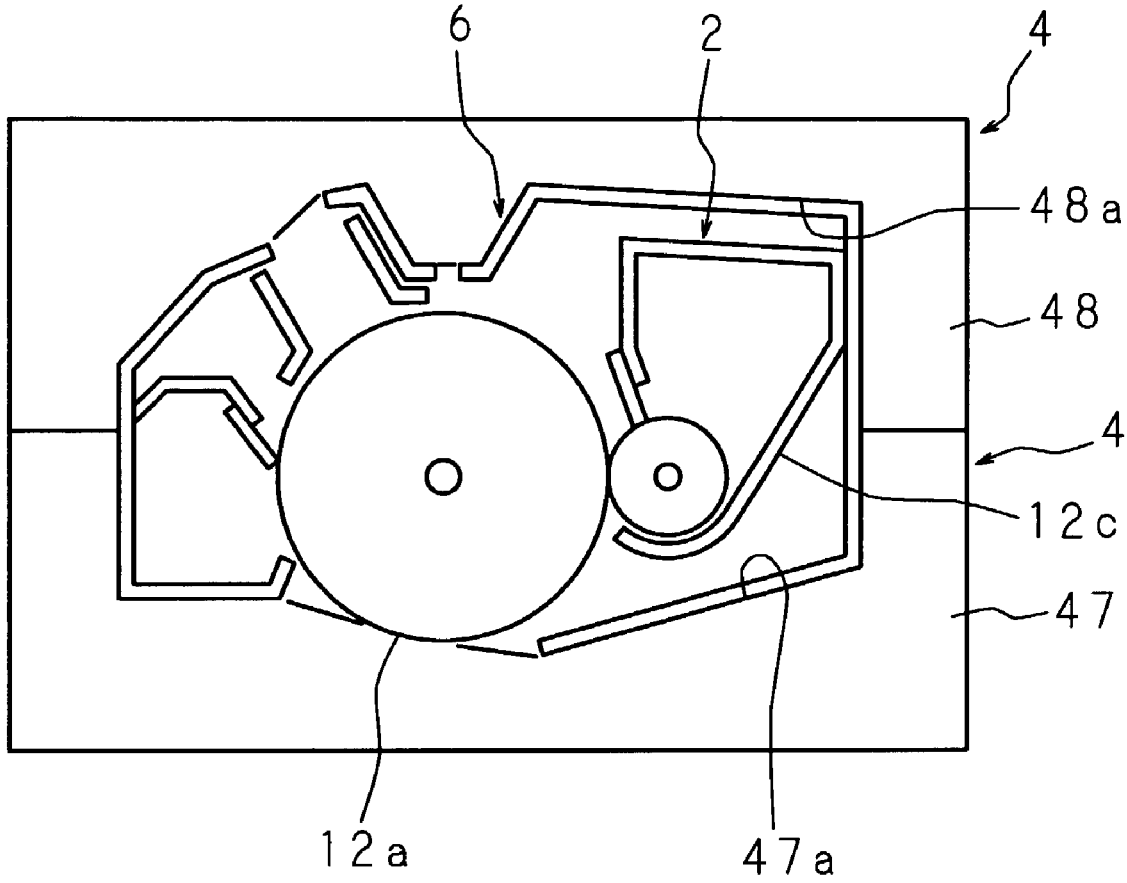
FIG. 12 is an explanatory view for packing a photosensitive drum by a packing case of the present invention.
Figure 13:
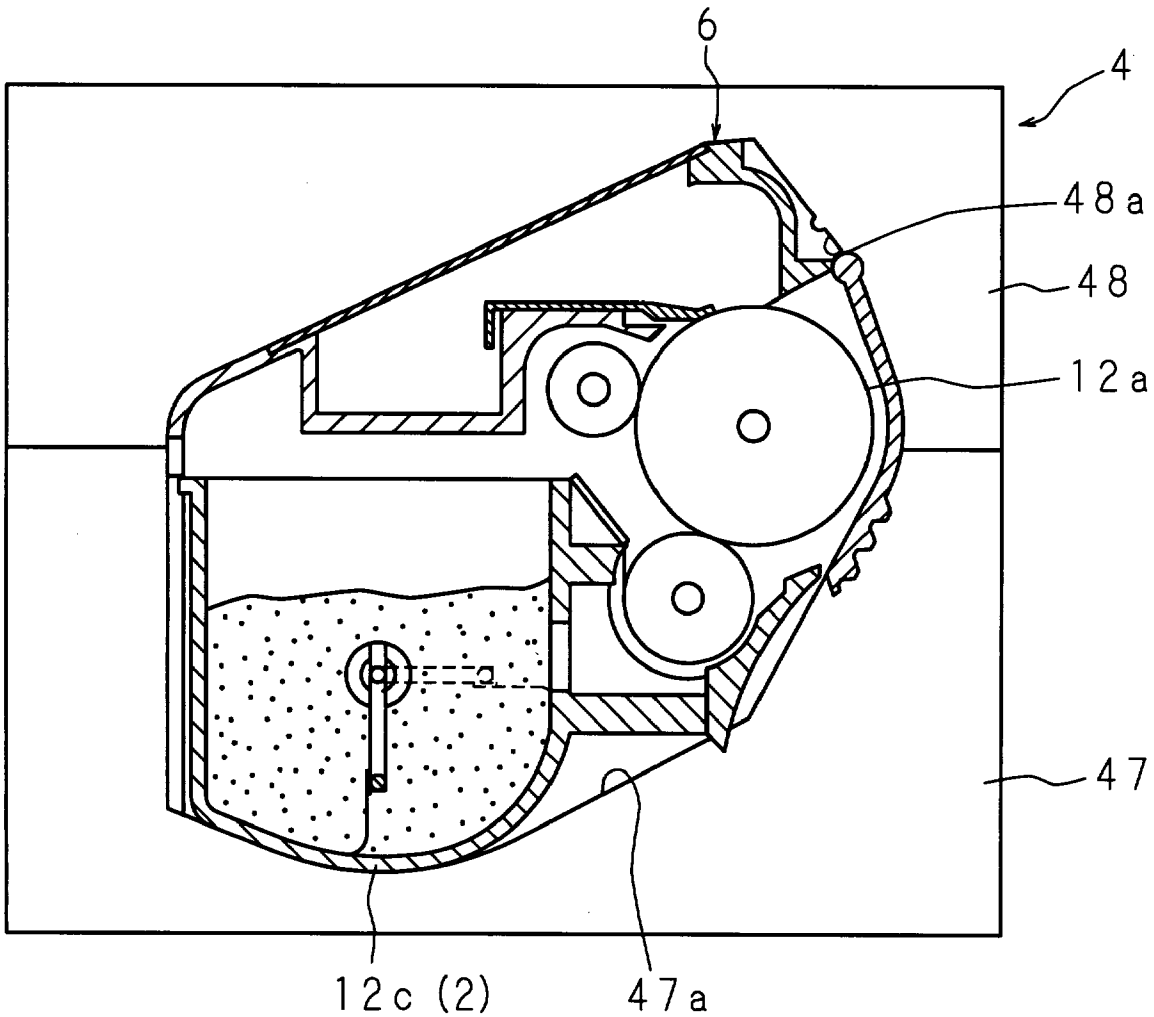
FIG. 13 is an explanatory view for packing a photosensitive drum by a packing case of the present invention.

FIG. 12 and FIG. 13 are explanatory views for packing a photosensitive drum.

In recent years, since the photosensitive drum 12*a* and the developer unit 12*c* are minimized, as shown in FIG. 12 and FIG. 13, a drum cartridge 6 incorporating these photosensitive drum 12*a* and developer unit 12*a* as a single unit can be packed by the second packing member 4. The second packing member 4 for packing this drum cartridge 6 is composed of a box member 47 having a recessed storage portion 47*a* for storing the lower portion of the drum cartridge 6 and a lid member 48 having a recessed storage portion 48*a* for storing the upper portion of the drum cartridge 6, and the entire drum cartridge 6 is stored in these two recessed storage portions 47*a* and 48*a*. Consequently, the user needs to insert only one drum cartridge 6 into the image forming apparatus A, and therefore it is possible to reduce the user's work for replacement. In this case, a structure in which the toner cartridge 2 is placed on the lower side with its opening facing upward as in the second packing member 4 of FIG. 13 can more effectively prevent scattering of the toner in the image forming apparatus A compared to the second packing member 4 of FIG. 12. Moreover, even in a structure in which the toner cartridge 2 and the drum cartridge 6 are provided separately, the toner cartridge 2 and the drum cartridge 6 can be packed by a single second packing member 4. In this case, it is possible to reduce the amount of the packing material compared to packing the toner cartridge 2 and the drum cartridge 6 separately.

As described in detail above, according to the first aspect of the packing case of the present invention for an image forming apparatus, since the packing case comprises the first packing member for packing the image forming apparatus main body; and the second packing member for packing the toner cartridge and to be inserted and fixed in the sheet storage space formed between the reading section and the image forming section, it is possible to decrease the overall size of the packing case and reduce the cost of the packing case. Moreover, since the second packing member is inserted and fixed in the sheet storage space, it is possible to support the reading section of the image forming apparatus by this second packing member, and a shock absorbing material for use exclusively in the sheet storage space is unnecessary, thereby improving the packing performance.

According to the second aspect of the packing case of the present invention for an image forming apparatus, in the first aspect of the packing case of the present invention, since the second packing member is composed of two pieces for holding both end portions of the toner cartridge, respectively, a shock absorbing member for use exclusively in the sheet storage space is unnecessary.

According to the third aspect of the packing case of the present invention for an image forming apparatus, in the first or second aspect of the packing case of the present invention, since the second packing member is made of a shock absorbing material, it is possible to protect the reading section and toner cartridge of the image forming apparatus from shock applied to the image forming apparatus during shipment.

According to the fourth aspect of the packing case of the present invention for an image forming apparatus, in any one of the first through third aspects of the packing case of the present invention, since the second packing member has a recessed storage portion for storing the toner cartridge, it is possible to protect the toner cartridge entirely and increase the rigidity for supporting the reading section.

According to the fifth aspect of the packing case of the present invention for an image forming apparatus, since the packing case comprises the first packing member for packing the image forming apparatus from which the drum unit is removed; and the second packing member for storing and packing the drum unit and to be inserted and fixed in the sheet storage space, it is possible to decrease the overall size of the packing case and reduce the cost of the packing case.

Further, according to the first aspect of the packing method of the present invention for an image forming apparatus, since the toner cartridge is packed by the second packing member and the packed toner cartridge is inserted and fixed in the sheet storage space formed between the reading section and the image forming section, it is possible to decrease the size of the packing case for the image forming apparatus and reduce the cost of the packing case.

According to the second aspect of the packing method of the present invention for an image forming apparatus, in the first aspect of the packing method of the present invention, since the toner cartridge is inserted and fixed in the sheet storage space after making the toner to be in a state under which the toner container not to leak out from the outlet, it is possible to prevent the toner in the toner cartridge from scattering in the image forming apparatus.

According to the third aspect of the packing method of the present invention for an image forming apparatus, in the first aspect of the packing method of the present invention, since the toner cartridge is packed in a state under which the developer in the developer container does not flow into the toner container and then this packed toner cartridge is inserted and fixed in the sheet storage space, it is possible to prevent the developer from mixing into the toner in the toner container during the shipment of the image forming apparatus.

According to the fourth aspect of the packing method of the present invention for an image forming apparatus, since the drum unit is packed by the second packing member and then this packed drum unit is inserted and fixed in the sheet storage space, it is possible to decrease the size of the packing case for the image forming apparatus and reduce the cost of the packing case.

According to the fifth aspect of the packing method of the present invention for an image forming apparatus, since the photosensitive drum and the toner cartridge are packed by the second packing member and then these packed photosensitive drum and toner cartridge are inserted and fixed in the sheet storage space, it is possible to decrease the size of the packing case for the image forming apparatus and reduce the cost of the packing case.

According to the first aspect of the image forming apparatus of the present invention, since the image forming apparatus is packed by the packing case comprising the first packing member for packing the image forming apparatus main body; and the second packing member for packing the toner cartridge and to be inserted and fixed in the sheet storage space formed between the reading section and the image forming section, it is possible to decrease the overall size of the packing case and reduce the cost of the packing case. Moreover, since the second packing member is inserted and fixed in the sheet storage space, it is possible to support the reading section of the image forming apparatus by this second packing member, and a shock absorbing material for use exclusively in the sheet storage space is unnecessary, thereby improving the packing performance.

According to the second aspect of the image forming apparatus of the present invention, in the first aspect of the image forming apparatus of the present invention, since the second packing member is composed of two pieces for holding both end portions of the toner cartridge, respectively, a shock absorbing member for use exclusively in the sheet storage space is unnecessary.

According to the third aspect of the image forming apparatus of the present invention, in the first or second aspect of the image forming apparatus of the present invention, since the second packing member is made of a shock absorbing material, it is possible to protect the reading section and toner cartridge from shock applied to the image forming apparatus during shipment.

According to the fourth aspect of the image forming apparatus of the present invention, in any one of the first through third aspects of the image forming apparatus of the present invention, since the second packing member has a recessed storage portion for storing the toner cartridge, it is possible to protect the toner cartridge entirely and increase the rigidity for supporting the reading section.

According to the fifth aspect of the image forming apparatus of the present invention, since the image forming apparatus is packed by the packing case comprising the first packing member for packing the image forming apparatus from which the drum unit is removed; and the second packing member for storing and packing the drum unit and to be inserted and fixed in the sheet storage space, it is possible to decrease the overall size of the packing case and reduce the cost of the packing case.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

an image forming apparatus main body including a reading section having a scanner unit for reading a document image, an image forming section having an image forming unit for forming an image according to image data read by said reading section and a sheet feed unit for feeding a sheet to said image forming unit, and a sheet storage space, formed to be open to outside between said reading section and said image forming section, for storing a sheet transported from said image forming unit; and a toner cartridge containing toner to be supplied to said image forming unit and adapted to be inserted into and removed from said image forming apparatus main body, wherein said image forming apparatus main body is packed by a first packing member, and said toner cartridge is packed by a second packing member being formed to be inserted and fixed in said sheet storage space of said image forming apparatus main body packed by said first packing member, and is inserted and fixed in said sheet storage space.

2. The image forming apparatus as set forth in claim 1, wherein said second packing member includes two pieces for holding both end portions of said toner cartridge, respectively.

3. The image forming apparatus as set forth in claim 2, wherein said second packing member has a recessed storage portion for storing said toner cartridge.

4. The image forming apparatus as set forth in claim 1, wherein said second packing member is made of a shock absorbing material.

5. The image forming apparatus as set forth in claim 4, wherein said second packing member has a recessed storage portion for storing said toner cartridge.

* * * * *